US009630421B2

(12) United States Patent
Yanaka et al.

(10) Patent No.: US 9,630,421 B2
(45) Date of Patent: Apr. 25, 2017

(54) IMAGE FORMING APPARATUS AND IMAGE FORMING METHOD

(71) Applicants: Atsushi Yanaka, Saitama (JP); Yuki Tsuchiya, Kanagawa (JP)

(72) Inventors: Atsushi Yanaka, Saitama (JP); Yuki Tsuchiya, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/045,462

(22) Filed: Feb. 17, 2016

(65) Prior Publication Data

US 2016/0243820 A1 Aug. 25, 2016

(30) Foreign Application Priority Data

Feb. 20, 2015 (JP) ..... 2015-031856

(51) Int. Cl.

| | |
|---|---|
| ***B41J 2/205*** | (2006.01) |
| ***B41J 2/045*** | (2006.01) |
| ***B41J 2/21*** | (2006.01) |
| ***B41J 11/02*** | (2006.01) |
| ***B41J 3/407*** | (2006.01) |
| ***B41J 11/00*** | (2006.01) |
| ***B41J 19/14*** | (2006.01) |

(52) U.S. Cl.

CPC ..... *B41J 2/2054* (2013.01); *B41J 2/04551* (2013.01); *B41J 2/2128* (2013.01); *B41J 3/407* (2013.01); *B41J 11/002* (2013.01); *B41J 19/142* (2013.01)

(58) Field of Classification Search

CPC ..... B41J 11/002

See application file for complete search history.

(56) References Cited

U.S. PATENT DOCUMENTS

| | | | | |
|---|---|---|---|---|
| 6,084,620 | A | 7/2000 | Morikawa et al. | |
| 6,142,598 | A * | 11/2000 | Iwasaki | B41J 2/04505 347/9 |
| 6,161,928 | A | 12/2000 | Morikawa et al. | |
| 2004/0252173 | A1 * | 12/2004 | Ben-Zur | D06P 5/001 347/101 |

(Continued)

FOREIGN PATENT DOCUMENTS

| | | |
|---|---|---|
| JP | 10-016418 | 1/1998 |
| JP | 2012-192721 | 10/2012 |
| JP | 2012-223958 | 11/2012 |

*Primary Examiner* — Shelby Fidler

(74) *Attorney, Agent, or Firm* — Harness, Dickey & Pierce

(57) ABSTRACT

An image forming apparatus includes a carriage configured to scan with an ejection head for ejecting ink droplets that harden when exposed to active energy line onto a recording medium to form an image and an emitter unit for emitting the active energy line mounted thereon, and an image forming controller configured to control ejection of the ink droplets from the ejection head and scan of the carriage. The image forming controller forms an ink droplet film of an uppermost layer of an image made of multiple layers of ink droplet films with finer image quality than that of an ink droplet film of each lower layer other than the uppermost layer, and forms the ink droplet film of the each lower layer other than the uppermost layer with coarser image quality and in a shorter length of time than a length of time taken to form the uppermost layer.

17 Claims, 9 Drawing Sheets

(56) References Cited

U.S. PATENT DOCUMENTS

| | | | | |
|---|---|---|---|---|
| 2005/0237352 | A1* | 10/2005 | Yoneyama | B41J 2/21 347/9 |
| 2010/0033527 | A1* | 2/2010 | Kawakami | B41M 5/52 347/16 |
| 2011/0228023 | A1* | 9/2011 | Ozawa | B41J 2/2117 347/98 |
| 2012/0147077 | A1* | 6/2012 | Usuda | B41J 2/2117 347/12 |
| 2012/0229566 | A1* | 9/2012 | Matsuhashi | B41J 2/2114 347/37 |
| 2012/0237735 | A1 | 9/2012 | Sugai | |
| 2015/0328908 | A1* | 11/2015 | Hatanaka | B41J 13/0009 347/16 |

* cited by examiner

BIDIRECTIONAL

UNIDIRECTIONAL

IMAGE FORMING APPARATUS AND IMAGE FORMING METHOD

CROSS-REFERENCE TO RELATED APPLICATIONS

The present application claims priority to and incorporates by reference the entire contents of Japanese Patent Application No. 2015-031856 filed in Japan on Feb. 20, 2015.

BACKGROUND OF THE INVENTION

1. Field of the Invention

The present invention relates generally to an image forming apparatus, an image forming method, and a non-transitory computer-readable medium computer-readable recording media.

2. Description of the Related Art

Decorated plates have conventionally been used as interior parts for vehicles such as automobiles and exterior parts for electrical appliances. Generally, interior parts for vehicles and exterior parts for electrical appliances include a base material made of resin and a print layer printed on the base material with ink or the like. In some type of interior parts for vehicles and exterior parts for electrical appliances, the print layer is configured as a light blocking layer.

The above-described interior parts for vehicles and exterior parts for electrical appliances may be manufactured by, for example, printing a light blocking layer (solid opacifying image portion) on a substrate made of resin such as polycarbonate by screen printing. Screen printing is a printing method of making a screen (stencil) where a print image is drawn from print data and applying solvent-based ink, thermal-curing ink, or the like to a substrate through the screen. Screen printing allows printing a light blocking layer in a single printing operation. Because the light blocking layer is required to exhibit a transmission density that prevents light transmission, it is generally necessary to form a thick film in a single printing operation. However, the thickness of a film that can be formed by screen printing is approximately up to 20 to 30 μm. Furthermore, because screen printing is single-color printing, it is necessary to print a plurality of layers using ink of different colors to form a decorative design or the like. This can increase man hours and time taken for processing and undesirably reduce productivity.

Meanwhile, printing techniques include, aside from screen printing, digital printing techniques such as laser-printer electrophotography, thermal transfer printing, and inkjet printing. The digital printing techniques allow directly drawing on a resin substrate without making a screen from print data and therefore are more suitable for small lots. Inkjet printing, which is one of the digital printing techniques, is a technique of performing printing by ejecting ink droplets from electronically-controlled recording head nozzles. Inkjet printing can print an image of a high resolution (i.e., image of high image quality) inexpensively as compared with screen printing by forming a thick film of multiple layers by repeating printing.

Japanese Laid-open Patent Application No. 2012-192721 (Patent Document 1) discloses a method for manufacturing a printed work (which may be a vehicle interior part or an electrical-appliance exterior part), in which a light blocking layer is formed by inkjet printing. The method for manufacturing a printed work disclosed in Patent Document 1 forms a light blocking layer and a light-blocking correction layer by repeatedly performing a step of ejecting droplets of radiation curing ink for forming the light blocking layer and a step of hardening the droplets of the radiation curing ink by irradiating the droplets with radiation.

However, the method for manufacturing a printed work (which may be a vehicle interior part or an electrical-appliance exterior part) disclosed in Patent Document 1 is disadvantageous in that, because multiple layers of a design film exhibiting fine image quality (high image quality) are printed to be laminated on one another, forming the multilayer film is undesirably time consuming and reduces productivity.

Meanwhile, to increase image quality with a conventional inkjet printing technique, it is desired to perform unidirectional printing. Accordingly, forming a multilayer thick film by repeating unidirectional printing is undesirably time consuming and reduces productivity.

Therefore, it is desirable to provide an image forming apparatus, an image forming method, and a non-transitory computer-readable medium capable of reducing the time taken to form an image made of multiple layers while maintaining fine image quality.

SUMMARY OF THE INVENTION

It is an object of the present invention to at least partially solve the problems in the conventional technology.

According to an aspect of the present invention, there is provided an image forming apparatus including: a carriage configured to scan in a direction perpendicular to a conveying direction of a recording medium with an ejection head and an emitter unit mounted on the carriage, the ejection head being configured to eject ink droplets that harden when exposed to active energy line onto the recording medium to form an image, the emitter unit being configured to emit the active energy line that cures the ink droplets landed on the recording medium; and an image forming controller configured to control ejection of the ink droplets from the ejection head and scan of the carriage, the image forming controller forming an ink droplet film of an uppermost layer of the image, the image being made of multiple layers of ink droplet films, with finer image quality than an ink droplet film of each lower layer other than the uppermost layer, and forming the ink droplet film of the each lower layer other than the uppermost layer with coarser image quality than the uppermost layer and in a shorter length of time than a length of time taken to form the uppermost layer.

According to another aspect of the present invention, there is provided an image forming method performed by an image forming apparatus including a carriage configured to scan in a direction perpendicular to a conveying direction of a recording medium with an ejection head and an emitter unit mounted on the carriage, the ejection head being configured to eject ink droplets that harden when exposed to active energy line onto the recording medium to form an image, the emitter unit being configured to emit the active energy line that cures the ink droplets landed on the recording medium, and an image forming controller configured to control ejection of the ink droplets from the ejection head and scan of the carriage, the image forming method including: forming an ink droplet film of an uppermost layer of an image made of multiple layers of ink droplet films by performing at least one of controls of forming the ink droplet film by unidirectional scan of the carriage, increasing the number of scans to a value higher than that for forming an ink droplet film of each lower layer other than the uppermost layer, increasing resolution of the image to a value higher than that of the ink droplet film of the each lower layer other than the uppermost layer, changing a landing order of the ink droplets to be ejected from the ejection heads, and reducing an ink droplet volume to be ejected from the ejection head to a value smaller than that of the ink droplet film of the each lower layer other than the uppermost layer; and forming the ink droplet film of the each lower layer other than the uppermost layer by bidirectional scan of the carriage.

According to still another aspect of the present invention, there is provided a non-transitory computer-readable medium including computer readable program codes, performed by an image forming apparatus, the image forming apparatus including a carriage configured to scan in a direction perpendicular to a conveying direction of a recording medium with an ejection head and an emitter unit mounted on the carriage, the ejection head being configured to eject ink droplets that harden when exposed to active energy line onto the recording medium to form an image, the emitter unit being configured to emit the active energy line that cures the ink droplets landed on the recording medium, and an image forming controller configured to control ejection of the ink droplets from the ejection head and scan of the carriage, the program codes when executed causing the image forming apparatus to execute: forming an ink droplet film of an uppermost layer of an image made of multiple layers of ink droplet films by performing at least one of controls of: forming the ink droplet film by unidirectional scan of the carriage, increasing the number of scans to a value higher than that for forming an ink droplet film of each lower layer other than the uppermost layer, increasing resolution of the image to a value higher than that of the ink droplet film of the each lower layer other than the uppermost layer, changing a landing order of the ink droplets to be ejected from the ejection heads, and reducing an ink droplet volume to be ejected from the ejection head to a value smaller than that of the ink droplet film of the each lower layer other than the uppermost layer; and forming the ink droplet film of the each lower layer other than the uppermost layer by bidirectional scan of the carriage.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. Although an inkjet recording apparatus is described as an example of an image forming apparatus in the embodiment discussed below, applications are not limited thereto. Aspects of the present invention are applicable to any image forming apparatus. Furthermore, aspects of the present invention are applicable, rather than only to inkjet recording apparatuses, to any image forming apparatus configured to form an image by ejecting ink droplets onto a recording medium.

The inkjet recording apparatus as an example of the image forming apparatus according to the present embodiment includes a head unit for ejecting ink of six colors, which are black (Bk), cyan (Cy), magenta (Ma), yellow (Ye), clear (Cl), and white (Wh), and forms an image by causing the head unit to reciprocate in a direction perpendicular to a recording-medium conveying direction.

Figure 1:
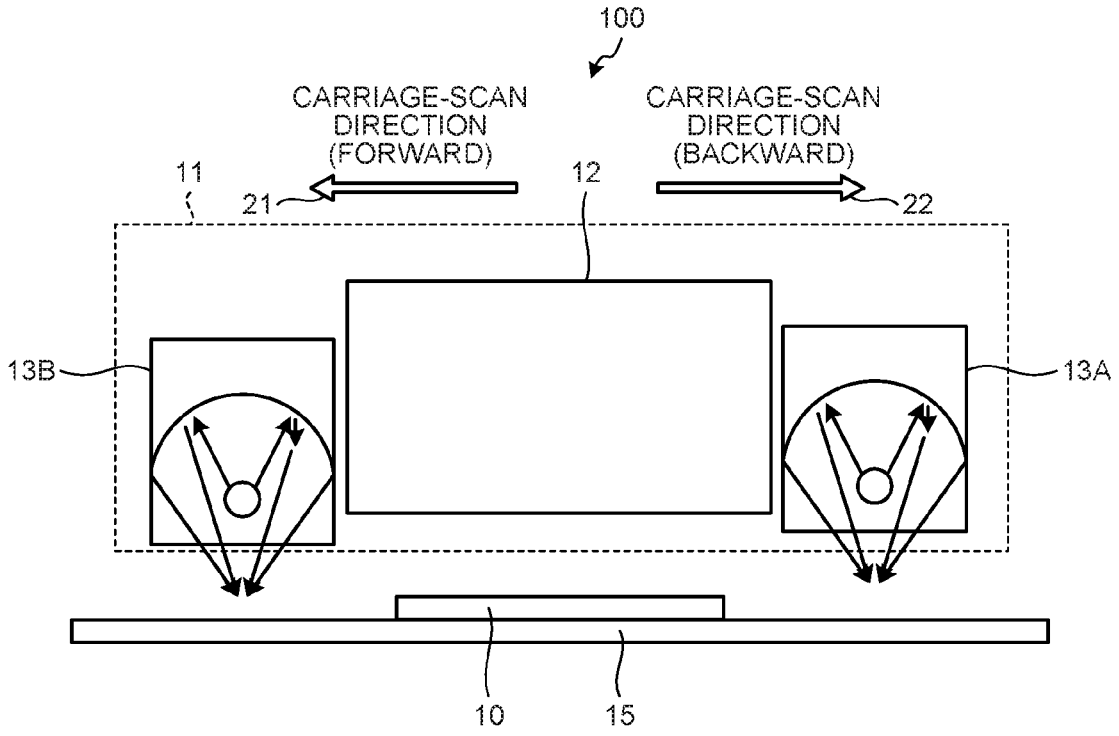
FIG. 1 is a diagram schematically illustrating an example of an image forming apparatus according to an embodiment.

FIG. 1 is a diagram schematically illustrating an example of the image forming apparatus according to the present embodiment. As illustrated in FIG. 1, an image forming apparatus 100 includes a carriage 11 configured to reciprocate (i.e., perform bidirectional scan) in a forward direction 21 and a backward direction 22 and a conveyance stage 15 configured to convey a recording medium 10. A head unit 12 including a plurality of ejection heads, from which ink droplets are to be ejected, and emitter units 13A and 13B, each configured to emit active energy line, are mounted on the carriage 11. The carriage 11 forms an image by scanning in the direction perpendicular to the conveying direction of the recording medium 10. Hereinafter, the emitter unit 13A, 13B may be simply referred to as the "emitter unit 13" when differentiation therebetween is unnecessary. The head unit 12 includes one or a plurality of ejection heads configured to form an image by ejecting ink droplets, which harden when exposed to active energy line, onto the recording medium 10. The head unit 12 may include, for example, a plurality of ejection heads that eject ink droplets of ultraviolet (UV) curing liquid, which hardens when irradiated with UV light. The head unit 12 may be configured to eject ink droplets from a plurality of nozzle rows provided in a single ejection head. As the ejection head included in the head unit 12, an ejection head including pressure producing means configured to produce a pressure for ejecting ink droplets can be used. Examples of the pressure producing means include a piezoelectric actuator using a piezoelectric element or the like, a thermal actuator using a heat element or the like, a shape-memory-alloy actuator utilizing a metallic phase change caused by a temperature change, and an electrostatic actuator utilizing an electrostatic force. The structure of the head unit 12 is not to that in which heads are independent on a per-color basis. The head unit 12 may alternatively be configured to include one or a plurality of ejection heads including nozzle rows of a plurality of nozzles, from which ink droplets of a plurality of colors are to be ejected.

The emitter unit 13 emits active energy line that cures ink droplets landed on the recording medium 10. Examples of the active energy line include visible light, UV light, infrared light, X rays, α rays, β rays, and γ rays. Among them, UV light is most favorable because of its fast reaction rate and because energy generator is relatively inexpensive. Emission energy is preferably equal to or higher than 100 $mJ/cm^2$ and more preferably equal to or higher than 200 $mJ/cm^2$. Hereinafter, description is given by way of example, in which active energy line is UV light.

The emitter unit 13A, which is active energy line emitting means, emits, for example, UV light of a wavelength that cures ink droplets ejected from the head unit 12. The emitter unit 13A is arranged downstream of the head unit 12 in the forward direction 21.

The emitter unit 13B, which is active energy line emitting means, emits, for example, UV light of a wavelength that cures ink droplets ejected from the head unit 12. The emitter unit 13B is arranged downstream of the head unit 12 in the backward direction 22.

Although the emitter units 13A and 13B are arranged at opposite ends of the head unit 12 in the example illustrated in FIG. 1, a structure of the carriage 11 is not limited thereto, and the carriage 11 may be configured as desired.

A light source of the emitter unit 13 may have an emission spectrum of a UV range such as the UV-A range, the UV-B range, or the UV-C range. Examples of the light source include a high-pressure mercury lamp, a metal halide lamp, an electrodeless UV lamp, a UV laser, a xenon lamp, an LED (light-emitting diode) lamp, and a germicidal lamp. Alternatively, an LED irradiation device, which exhibits favorable light emission efficiency at a peak wavelength and provides high irradiance by narrowing down light-emission wavelength to a specific narrow wavelength range and which is low in power consumption and has a long usable life, may be used. Meanwhile, while typical electrode lamps have peak irradiance of a few $W/cm^2$ at 365 nm, LED irradiation devices (which may be a 395-nm LED or a 405-nm LED) have peak irradiance of more than ten $W/cm^2$, which is several times larger than that of the typical electrode lamps. Thus, while an electrode lamp has an emission spectrum of a wide wavelength range, an LED irradiation device has a narrow emission spectrum about its center wavelength.

A lamp used as the light source of the emitter unit 13 is preferably selected based on a photo-polymerization initiator in ink composition and preferably has a peak emission wavelength that matches absorption characteristics of the photo-polymerization initiator. For example, if reaction of the photo-polymerization initiator in the ink composition peaks at a wavelength of 365 nm, it is preferable to select, for example, a metal halide lamp exhibiting high output in a wavelength range of 300 to 450 nm. If reaction of the photo-polymerization initiator in the ink composition peaks at a wavelength of 240 nm, it is preferable to select a high-pressure mercury lamp or the like, for example.

An image partially having desired image quality can be obtained by controlling energy-emission conditions (such as a light emission wavelength, leveling time, and energy-emission intensity) of the emitter unit 13.

The conveyance stage 15 is arranged below a moving range of the carriage 11. The recording medium 10 is placed on the conveyance stage 15. The recording medium 10 placed on the conveyance stage 15 is conveyed on the conveyance stage 15 to a position below the head unit 12, which is an image forming part, where an image is formed on the recording medium 10. More specifically, a desired image can be formed on the recording medium 10 by ejecting, from the head unit 12, UV-curing ink droplets onto the recording medium 10 while moving the carriage 11.

Meanwhile, use of active energy line curing ink in forming an image on the recording medium 10 increases available choices of a material of the recording medium 10 as compared with typical aqueous ink, and makes it possible to form an image even on an impermeable recording medium made of, for example, a plastic material (e.g., polypropylene or polyethylene). In short, forming an image with active energy line curing ink advantageously provides a wider choice of the recording medium 10. Hereinafter, it is assumed that the recording medium 10 is an impermeable recording medium. Hereinafter, a recording medium may sometimes be referred to as "base material".

Figure 2:
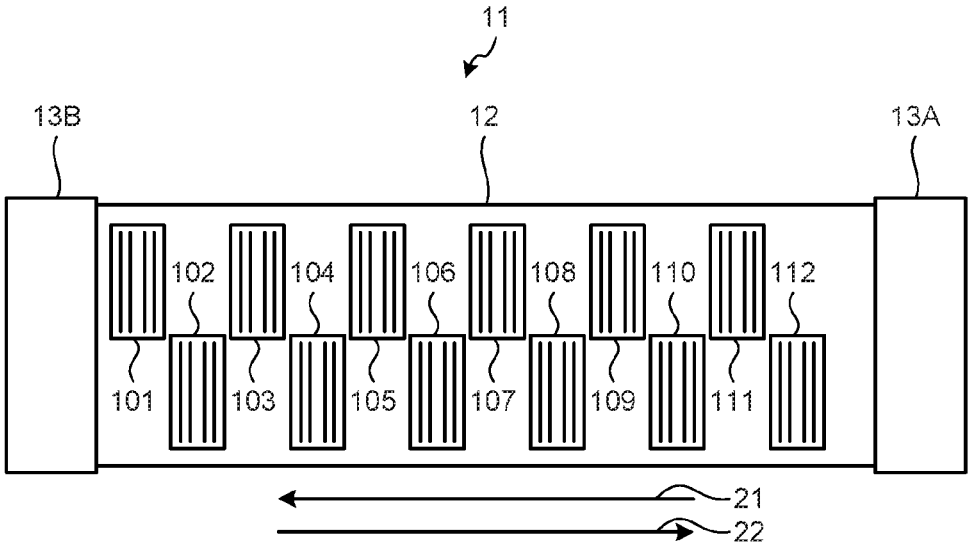
FIG. 2 is a diagram illustrating an example of a configuration of a carriage.

A configuration of the head unit 12 mounted on the carriage 11 is described below with reference to FIG. 2. FIG. 2 is a diagram illustrating an example of a configuration of the carriage.

As illustrated in FIG. 2, the head unit 12 includes ejection heads (hereinafter, sometimes simply referred to as the "heads") 101 to 112, from which ink droplets are to be ejected. The term "head unit" collectively denotes the heads 101 to 112 but does not indicate that the heads 101 to 112 are configured as an independent unit.

The ejection heads 101 to 112 may eject ink droplets of, for example, six colors of black (Bk), cyan (Cy), magenta (Ma), yellow (Ye), clear (Cl), and white (Wh). Referring to the example illustrated in FIG. 2, two heads for a same color are connected for each of the colors. For example, the ejection heads 101 to 112 may be configured such that the heads 101 and 102 are for black (Bk), the heads 103 and 104 are for cyan (Cy), the heads 105 and 106 are for magenta (Ma), the heads 107 and 108 are for yellow (Ye), the heads 109 and 110 are for clear (Cl), and the heads 111 and 112 are for white (Wh). Hereinafter, any one of the 101 to 112 may be simply referred to as the "ejection head" or the "head" when differentiation thereamong is unnecessary.

Each of the heads 101 to 112 includes a set of four nozzle rows providing a resolution of 600 dpi (dots per inch), where each row providing a resolution of 150 dpi. For example, black ink is ejected from four nozzle rows of each of the heads 101 and 102. Accordingly, a head print width corresponding to two heads (four nozzle rows) is provided by a single scan of the carriage 11 in the direction perpendicular to the carriage moving direction. The same is true for the other colors.

Note that the number of colors is not limited to six, but may alternatively be four colors of black, cyan, magenta, and yellow, or still another number.

Figure 3:
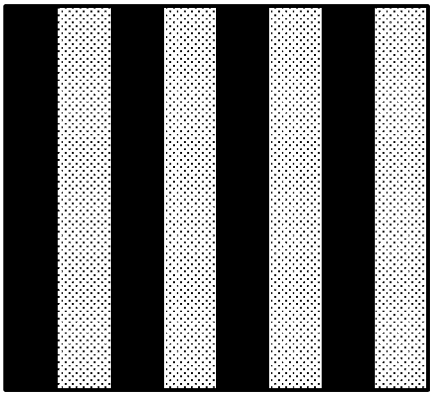
FIG. 3 is a diagram illustrating an example of an image formed by bidirectionally scanning the carriage.
Figure 4:
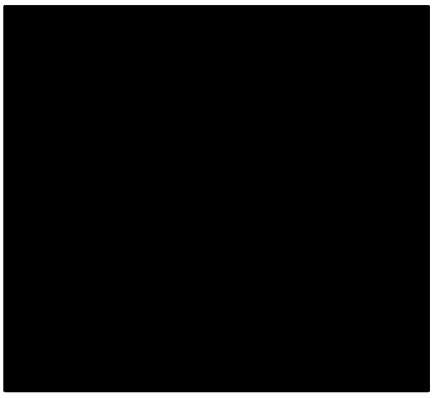
FIG. 4 is a diagram illustrating an example of an image formed by unidirectionally scanning the carriage.

Scan directions of the carriage 11 and images are described below with reference to FIGS. 3 and 4. FIG. 3 is a diagram illustrating an example of an image formed by bidirectionally scanning the carriage. FIG. 4 is a diagram illustrating an example of an image formed by unidirectionally scanning the carriage.

As illustrated in FIG. 3, image quality of a final image formed by bidirectional printing largely depends on landing position accuracy of ink droplets (dots) due to ejection deflection, which is a characteristic of the individual ejection nozzles of each of the heads 101 to 112, repeat accuracy of the conveyance stage 15, and like. As illustrated in FIG. 3, when a same color, e.g., black (Bk), is printed by bidirectional printing, the length of time between when ink droplets ejected from the nozzles land on the recording medium 10 and when the ink droplets are irradiated with UV light varies between the forward direction 21 and the backward direction 22. More specifically, ink droplets ejected from the heads 101 and 102 for black (Bk) harden under UV light emitted from the emitter unit 13A in the forward direction 21, while ink droplets ejected from the heads 101 and 102 for black (Bk) harden under UV light emitted from the emitter unit 13B in the backward direction 22.

Put another way, while the layout distance between the heads 101 and 102 for black (Bk) and the emitter unit 13A is long, the layout distance between the heads 101 and 102 for black (Bk) and the emitter unit 13B is short. For this reason, in a situation where the scan speed of the carriage 11 in the forward direction 21 and that in the backward direction 22 are equal, the length of time between when ink droplets ejected from the nozzles of the heads 101 and 102 land on the recording medium 10 and when the ink droplets are irradiated with UV light in the forward direction 21 is long, but the same in the backward direction 22 is short.

Because of the above-described reason, a difference occurs in the length of time between when ink droplets ejected from the nozzles of the heads 101 and 102 land on the recording medium 10 and when the ink droplets are irradiated with UV light, which causes leveling of the ink droplets to vary between the forward direction 21 and the backward direction 22 to thereby cause image quality of a final image to undesirably have unevenness (banding). The same is true for the heads for the other colors.

As illustrated in FIG. 4, when unidirectional printing is performed, because the above-described difference in the length of time between when ink droplets land on the recording medium 10 and when the ink droplets are irradiated with UV light does not occur, a final image can have favorable image quality.

In view of the above circumstances, the present embodiment is configured to perform unidirectional printing in a printing process for an uppermost layer regardless of a printing process for a layer(s) lower than the uppermost layer, so that a favorable image can be obtained as a final printed image. Even if unevenness (banding) occurs in image quality of an image by performing bidirectional printing in a lower layer as illustrated in FIG. 3, a final image having favorable image quality can be obtained as illustrated in FIG. 4 by performing unidirectional printing on an upper (uppermost) layer of the lower layer.

Figure 5:
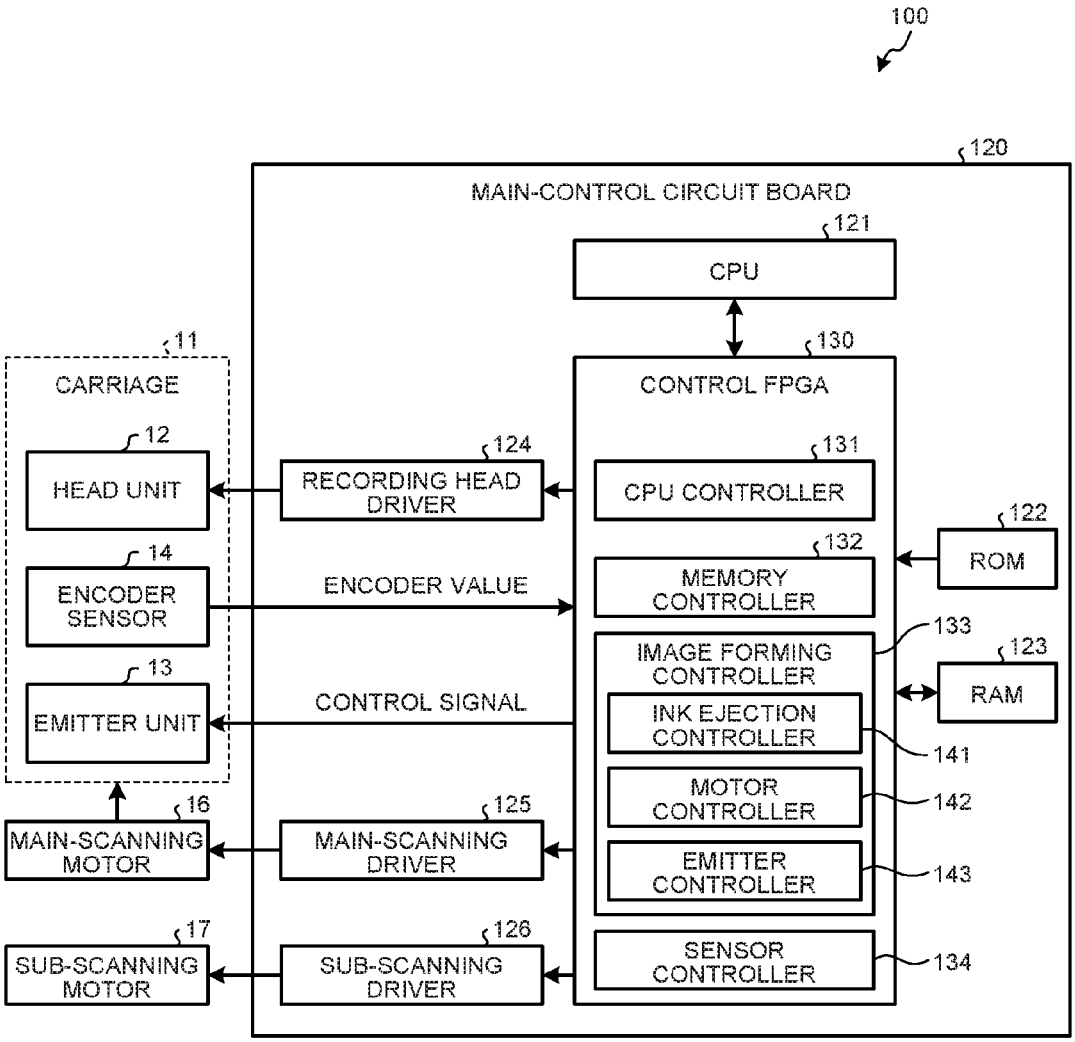
FIG. 5 is a diagram illustrating an example of a functional configuration of the image forming apparatus.

A functional configuration of the image forming apparatus 100 according to the present embodiment is described below with reference to FIG. 5. FIG. 5 is a diagram illustrating an example of the functional configuration of the image forming apparatus.

As illustrated in FIG. 5, the image forming apparatus 100 includes a CPU 121, a ROM 122, a RAM 123, a recording head driver 124, a main-scanning driver 125, a sub-scanning driver 126, a control FPGA (field-programmable gate array) 130, the head unit 12, the emitter unit 13, an encoder sensor 14, a main-scanning motor 16, and a sub-scanning motor 17.

The CPU 121, the ROM 122, the RAM 123, the recording head driver 124, the main-scanning driver 125, the sub-scanning driver 126, and the control FPGA 130 are mounted on a main-control circuit board 120. The head unit 12, the emitter unit 13, and the encoder sensor 14 are mounted on the carriage 11.

The CPU 121 performs overall control of the image forming apparatus 100. For example, the CPU 121 executes various control program instructions stored in the ROM 122 while using the RAM 123 as a work area, thereby outputting control commands for controlling various operations of the image forming apparatus 100.

The recording head driver 124, the main-scanning driver 125, and the sub-scanning driver 126 are drivers for driving the head unit 12, the main-scanning motor 16, and the sub-scanning motor 17, respectively.

The control FPGA 130 controls various operations of the image forming apparatus 100 in cooperation with the CPU 121. The control FPGA 130 may include, for example, a CPU controller 131, a memory controller 132, an image forming controller 133, and a sensor controller 134 as functional elements.

The CPU controller 131 communicates with the CPU 121 to pass various types of information acquired by the control FPGA 130 to the CPU 121 and receives control commands output from the CPU 121.

The memory controller 132 performs memory control for the CPU 121 accessing the ROM 122 and the RAM 123.

The image forming controller 133 includes an ink ejection controller 141, a motor controller 142, and an emitter controller 143.

The image forming controller 133 is described below. The image forming controller 133 controls ejection of ink droplets from the ejection heads and scan of the carriage 11.

The image forming controller 133 forms an image made of multiple layers of ink droplet films as follows. The image forming controller 133 forms an ink droplet film of an uppermost layer 33 with finer image quality than an ink droplet film of each lower layer other than the uppermost layer 33, and forms the ink droplet film of the each lower layer other than the uppermost layer 33 with coarser image quality than the uppermost layer 33 and in a shorter length of time than a length of time taken to form the ink droplet film of the uppermost layer 33.

The image forming controller 133 may form the ink droplet film of the uppermost layer 33 by performing at least one of the following control actions: forming the ink droplet film by unidirectional scan of the carriage 11, increasing the number of scans to a value higher than that for forming the ink droplet film of the each lower layer other than the uppermost layer 33, increasing resolution of the image to a value higher than that of the ink droplet film of the each lower layer other than the uppermost layer 33, changing the landing order of the ink droplets to be ejected from the ejection heads, and reducing an ink droplet volume to be ejected from the ejection heads to a value smaller than that of the ink droplet film of the each lower layer other than the uppermost layer 33. The control action, to be performed by the image forming controller 133, of changing the landing order of the ink droplets is, more specifically, a control action of randomly changing a placement order of the ink droplets to be ejected with reference to the scan direction of the carriage 11.

The image forming controller 133 may also perform a control action of forming the ink droplet film of the each lower layer other than the uppermost layer 33 by bidirectional scan of the carriage 11.

The image forming controller 133 may perform any one of a control action of forming the ink droplet film of the each lower layer other than the uppermost layer 33 by changing the landing order of the ink droplets to be ejected from the ejection heads and a control action of forming the same by setting the landing order of the ink droplets according to the scan direction of the carriage 11.

The image forming controller 133 may perform a control action of reducing the size of the ink droplets to be ejected from the ejection heads to form the ink droplet film of the uppermost layer 33 to a size smaller than the size of the ink droplets forming the ink droplet film of the each lower layer other than the uppermost layer 33.

The image forming controller 133 may perform a control action of, even if the number of layers of the ink droplet films making up the image varies, adjusting a total of ink droplet volumes to be ejected to form all the layers to a fixed value.

Assume that an image is made of multiple layers of ink droplet films including a lowermost layer 31, one or more intermediate layers 32 (hereinafter, sometimes simply referred to as the "intermediate layer 32"), and the uppermost layer 33. The image forming controller 133 sets the size of the ink droplets to be ejected from the ejection heads to form an ink droplet film of the lowermost layer 31 contacting the recording medium 10 to a first size, that of ink droplets forming the one or more intermediate layers 32 to a second size, and that of ink droplets forming the uppermost layer 33 to a third size. The second size is substantially equal to or smaller than the first size. The third size is smaller than the second size.

The ink ejection controller 141 controls operation of the recording head driver 124 in accordance with a control command fed from the CPU 121, thereby controlling ejection timing, ejection volume, and the like of ink droplets to be ejected from the head unit 12, which is driven by the recording head driver 124.

The motor controller 142 controls the main-scanning motor 16, which is driven by the main-scanning driver 125, by controlling operation of the main-scanning driver 125 in accordance with a control command fed from the CPU 121, thereby controlling traveling in the main-scanning direction of the carriage 11. The motor controller 142 also controls the sub-scanning motor 17, which is driven by the sub-scanning driver 126, by controlling operation of the sub-scanning driver 126 in accordance with a control command fed from the CPU 121, thereby controlling move in the sub-scanning direction of the recording medium 10 on the conveyance stage 15.

The emitter controller 143 controls the energy-emission conditions (such as a light emission wavelength, leveling time, and energy-emission intensity) of the emitter unit 13 by controlling operation of the emitter unit 13 in accordance with a control command fed from the CPU 121, thereby controlling emission of active energy line that cures ink droplets landed on the recording medium 10.

The emitter controller 143 controls operation of the emitter unit 13, thereby performing a control action of causing the emitter unit 13 to emit active energy line in the following manner. That is, when forming an ink droplet film of the lowermost layer 31 contacting the recording medium 10, a length of time between landing of ink droplets on the recording medium 10 and irradiation of the ink droplets with active energy line is set to a value longer than that for forming an ink droplet film of each upper layer other than the lowermost layer 31, and when forming an ink droplet film of the uppermost layer 33, a length of time between landing of ink droplets on an ink droplet film of an immediately-precedingly-formed lower layer and irradiation of the ink droplets with active energy line is set to a value substantially equal to or shorter than that for forming the lower layer.

The emitter controller 143 performs a control action of causing the emitter unit 13 to emit active energy line in the following manner. That is, when forming the ink droplet film of the lowermost layer 31 contacting the recording medium 10, the length of time between landing of the ink droplets on the recording medium 10 and irradiation of the ink droplets with active energy line is set to a value longer than that for forming an ink droplet film of each of the one or more intermediate layers 32, and when forming the ink droplet film of the uppermost layer 33, a length of time between landing of the ink droplets on an ink droplet film of an immediately-precedingly-formed one of the intermediate layers 32 and irradiation of the ink droplets with active energy line is set to a value substantially equal to or shorter than that for forming an ink droplet film of the intermediate layer 32.

The sensor controller 134 performs processing on a sensor signal such as an encoder value output from the encoder sensor 14.

The elements described above are an example of control functions implemented by the control FPGA 130. Various control functions other than those described above may further be implemented by the control FPGA 130. The image forming apparatus 100 may be configured such that all or a part of the control functions is implemented in program instructions to be executed by the CPU 121 or other general-purpose CPU(s). The image forming apparatus 100 may be configured such that a part of the control functions is implemented by another FPGA than the control FPGA 130 or dedicated hardware such as an ASIC (application specific integrated circuit).

The head unit 12 is driven by the recording head driver 124, operation of which is controlled by the CPU 121 and the control FPGA 130, to form an image by ejecting ink droplets onto the recording medium 10 on the conveyance stage 15.

The emitter unit 13 forms an image by causing the light source to emit light in accordance with a control signal output from the emitter controller 143 to irradiate ink droplets landed on the recording medium 10 with active energy line that cures the ink droplets, thereby hardening the ink droplets.

The emitter unit 13 is controlled by the emitter controller 143 so as to, when forming the ink droplet film of the lowermost layer 31 contacting the recording medium 10, set the length of time between landing of the ink droplets on the recording medium 10 and irradiation of the ink droplets with active energy line longer than that for forming the ink droplet film of the each upper layer other than the lowermost layer 31 and, when forming the ink droplet film of the uppermost layer 33, set the length of time between landing of ink droplets on the ink droplet film of the immediately-precedingly-formed lower layer and irradiation of the ink droplets with active energy line substantially equal to or shorter than that for forming the ink droplet film of the lower layer.

The emitter unit 13 is controlled by the emitter controller 143 so as to, when forming the ink droplet film of the lowermost layer 31 contacting the recording medium 10, set the length of time between landing of the ink droplets on the recording medium 10 and irradiation of the ink droplets with active energy line longer than that for forming the ink droplet film of each of the one or more intermediate layers 32 and, when forming the ink droplet film of the uppermost layer 33, set the length of time between landing of the ink droplets on the ink droplet film of the immediately-precedingly-formed one of the intermediate layers 32 and irradiation of the ink droplets with active energy line substantially equal to or shorter than that for forming the ink droplet film of the intermediate layer 32.

The encoder sensor 14 acquires an encoder value by detecting a marker on an encoder sheet (not shown) and outputs the encoder value to the control FPGA 130. The encoder value is sent from the control FPGA 130 to the CPU 121, where the encoder value is used in calculation of a position, velocity, and the like of the carriage 11, for example. The CPU 121 generates a control command for controlling the main-scanning motor 16 from the position and the velocity of the carriage 11 calculated from the encoder value and outputs the control command.

Figure 6:
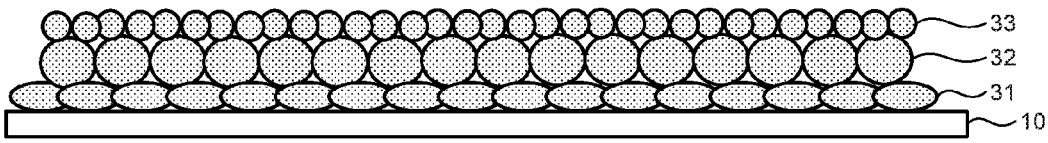
FIG. 6 is a diagram illustrating an example of a schematic cross section of a formed layer formed of a plurality of ink droplet films.

An image, made of multiple layers of ink droplet films, formed by the image forming apparatus 100 according to the present embodiment is described below with reference to FIG. 6. FIG. 6 is a diagram illustrating an example of a schematic cross section of a formed layer formed of a plurality of ink droplet films.

As illustrated in FIG. 6, the image is made of multiple layers of ink droplet films including, for example, the lowermost layer 31, the one or more intermediate layers 32, and the uppermost layer 33 on the recording medium 10. Although the example, in which a thick film is formed by laminating three ink droplet films, is described with reference to FIG. 6, the number of laminated layers is not limited to three but can be any number.

Referring to the example image illustrated in FIG. 6, image formation processes for forming an image made of multiple layers are performed by moving the carriage 11, on which the heads 101 to 112 (the head unit 12) are mounted, to perform scan in the direction perpendicular to the scan direction of the conveyance stage 15, which conveys the recording medium 10. The image formation processes of the present embodiment are described below with reference not only to FIG. 6 but also to FIGS. 1 and 2.

When forming the ink droplet film of the lowermost layer 31 using black (Bk) ink, for example, the UV curing ink is ejected onto the recording medium 10 from the heads 101 and 102 during when (i.e., during forward traveling of) the carriage 11 is moved in the forward direction 21 to form an image. While the carriage 11 is moved in the forward direction 21, UV light that cures the UV curing ink is emitted from the emitter unit 13A concurrently with image formation. A similar process is performed for the backward direction 22; however, in the backward direction 22, UV light is emitted from the emitter unit 13B. Because the ink droplet film of the lowermost layer 31 is the layer directly contacting the recording medium 10, it is necessary to cause the ink droplet film to adhere to the recording medium 10 so as not to be peeled off therefrom. For this purpose, the control action of setting the length of time between landing of the ink droplets on the recording medium 10 and irradiation of the ink droplets with UV light (active energy line) long may preferably be performed so that the ink droplets harden after sufficiently leveled. More specifically, because the layout distance from the heads 101 and 102 to the emitter unit 13A differs from that to the emitter unit 13B as described earlier, the control action of causing the length of time between landing of the ink droplets on the recording medium 10 and irradiation of the ink droplets with UV light (active energy line) to vary between the forward direction 21 and the backward direction 22 may preferably be performed. Furthermore, for the lowermost layer 31, the control action of setting an ink droplet volume to be ejected from the heads 101 and 102 large, thereby increasing the ink droplet size may preferably be performed. The control action of forming the lowermost layer 31 by bidirectional printing may preferably be performed. Thus, the control actions of increasing the ink droplet size and performing bidirectional printing may preferably be performed to increase print speed, thereby increasing productivity.

When forming an ink droplet film of the intermediate layer 32, because an adherend of the ink droplet film is the ink droplet film of the lowermost layer 31, it is unnecessary to wait until ink droplets are sufficiently leveled. For this reason, for the intermediate layer 32, it is preferable to cause the emitter unit 13 to irradiate the ink droplets with UV light before the ink droplets are sufficiently leveled by setting the length of time between landing of the ink droplets on the ink droplet film of the lowermost layer 31 and irradiation of the ink droplets with UV light (active energy line) shorter than that of the lowermost layer 31. In other words, for the intermediate layer 32, the control action of causing the emitter unit 13 to irradiate the ink droplets with UV light while the ink droplets are still standing may preferably be performed. As in the case of the lowermost layer 31 described above, the control action of causing the length of time between landing of the ink droplets on the recording medium 10 and irradiation of the ink droplets with UV light (active energy line) to vary between the forward direction 21 and the backward direction 22 may preferably be performed. The control action of setting the ink droplet volume to be ejected from the heads 101 and 102 large, thereby increasing the ink droplet size may preferably be performed. In other words, the control action of making the ink droplet volume to be substantially equal to that of the lowermost layer 31 may preferably be performed. The control action of forming the intermediate layer 32 by bidirectional printing may preferably be performed. Thus, the control actions of increasing the ink droplet size and performing bidirectional printing may preferably be performed to increase print speed, thereby increasing productivity.

It is desirable to form the uppermost layer 33 so as to provide favorable image quality to a final image. For this purpose, the image formation process for the uppermost layer 33 is preferably controlled to perform unidirectional printing. When forming the ink droplet film of the uppermost layer 33, because an adherend of the ink droplet film is an ink droplet film of the intermediate layer 32, it is unnecessary to wait until the ink droplets are sufficiently leveled. For this reason, for the uppermost layer 33, the control action of setting the length of time between landing of the ink droplets on the ink droplet film of the intermediate layer 32 and irradiation of the ink droplets with UV light (active energy line) to a value substantially equal to or shorter than that for the intermediate layer 32 may preferably be performed so that the emitter unit 13 irradiates the ink droplets with UV light before the ink droplets are sufficiently leveled. In other words, for the uppermost layer 33, the control action of causing the emitter unit 13 to irradiate the ink droplets with UV light while the ink droplets are still standing may preferably be performed. The control action of setting the ink droplet volume to be ejected from the heads 101 and 102 small, thereby reducing the ink droplet size may preferably be performed. In other words, the control action of making the ink droplet volume to be smaller than that of the lowermost layer 31 and the intermediate layer 32 may preferably be performed. In the example illustrated in FIG. 6, the size (diameter) of the ink droplets of the uppermost layer 33 is controlled to be substantially half the size (diameter) of the ink droplets of the intermediate layer 32. More specifically, the ink droplet volume to be ejected from the heads 101 and 102 and the length of time until the ejected ink droplets are irradiated with UV light (active energy line) that cures the ink droplets are controlled so that a pair of ink droplets of the uppermost layer 33 arranged side by side provides a total diameter substantially equal to the diameter of an ink droplet of the intermediate layer 32. By controlling the image formation process for the ink droplet film of the uppermost layer 33 as described above and performing unidirectional printing in the image formation process for the uppermost layer 33 regardless of the image formation processes for the lowermost layer 31 and the intermediate layer 32, a favorable image can be obtained as a final printed image.

As described above with reference to FIG. 6, in an image made of multiple layers of ink droplet films, because desired function and specification vary from one layer to another, it is desirable to control the image formation processes on a per-layer basis. Note that the image formation processes described with reference to FIG. 6 are only an example. Details of the control actions in the image formation processes of the present embodiment are described below.

In the present embodiment, each of the image formation processes for the respective layers may preferably perform at least any one of the following control actions (1) to (5):

(1) scan direction control (i.e., control of selecting either unidirectional scan or bidirectional scan of the carriage),
(2) number-of-scan control (i.e., control of the number of parts, into which nozzle rows are to be divided),
(3) image resolution control (i.e., control of increasing or decreasing image resolution),
(4) landing order control of the ink droplets to be ejected from the ejection heads (i.e., control of a placement order of the ink droplets to be ejected), and
(5) control of an ink droplet volume to be ejected from the ejection heads (i.e., control of the size of landing ink droplets).

When active energy line (UV) curing ink is employed as the ink droplets to be ejected, each of the image formation processes may preferably further perform at least any one of the following control actions (6) and (7):

(6) timing control for emission of the active energy line (UV light), and
(7) process-linear-velocity control (i.e., control of the linear velocity of the image formation process).

The present embodiment enables changing properties of coating of a final image as desired by performing at least any one of the control actions (1) to (5) described above and, furthermore, performing at least any one of the control actions (6) and (7). The control actions (1) to (7) may be combined as desired.

The scan direction (i.e., the scan direction of the carriage 11) control may be performed by, for example, selecting, by a user, unidirectional printing or bidirectional printing using software to be configured before printing. For example, forming an image of a fixed resolution by bidirectional printing increases print speed (i.e., increases productivity) as compared with forming the same by unidirectional printing. However, bidirectional printing can disadvantageously cause, for example, color difference between the forward and backward directions due to landing position accuracy of ink droplets and the like to occur, resulting in spread of the ink droplets and degradation in image quality. However, even if degradation in image quality occurs in an ink droplet film of a lower layer other than the uppermost layer 33, because another ink droplet film is formed as an upper layer in the next step, the degradation does not affect image quality of a final image. Thus, by forming each lower layer other than the uppermost layer 33 by bidirectional printing and forming the uppermost layer 33 by unidirectional printing, the time taken to form an image made of multiple layers of films can be reduced while maintaining fine image quality. In short, productivity can be increased while maintaining fine image quality.

Figure 7:
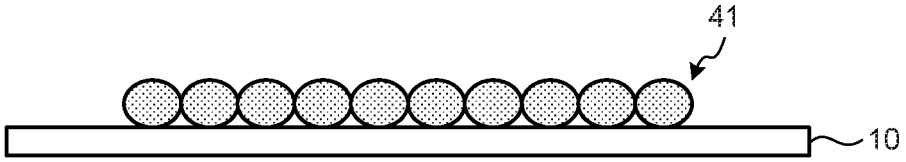
FIG. 7 is a diagram illustrating an example of a schematic cross section of an ink droplet film formed by unidirectional printing.
Figure 8:
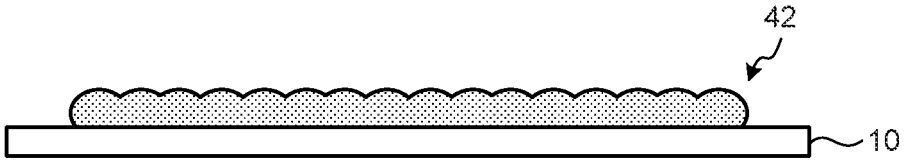
FIG. 8 is a diagram illustrating an example of a schematic cross section of an ink droplet film formed by bidirectional printing.

FIG. 7 is a diagram illustrating an example of a schematic cross section of an ink droplet film formed by unidirectional printing. FIG. 8 is a diagram illustrating an example of a schematic cross section of an ink droplet film formed by bidirectional printing. As illustrated in FIG. 7, because landing position accuracy of ink droplets 41 ejected in unidirectional printing are high, it is possible to harden the ink droplets 41 while the ink droplets 41 are still standing with less dot coalescence with adjacent ink droplets. Accordingly, image formation with high image quality specific to inkjet printing can be achieved. In contrast, as illustrated in FIG. 8, because ink droplets 42 ejected in bidirectional printing are poor in landing position accuracy, more dot coalescence of the ink droplets 42 with adjacent ink droplets occurs, and the ink droplets 42 are undesirably sufficiently leveled. As a result, for example, ink spreads on edge portions of an image, resulting in degradation in image quality of the image.

The landing order control of the ink droplets to be ejected from the ejection heads may be performed by, for example, changing an ejection-order mask to be used depending on a function of each layer. Ejection-order masks used in the present embodiment and images each formed with landed ink droplets using one of the ejection-order masks are described with reference to FIGS. 9 and 10.

Figure 9:
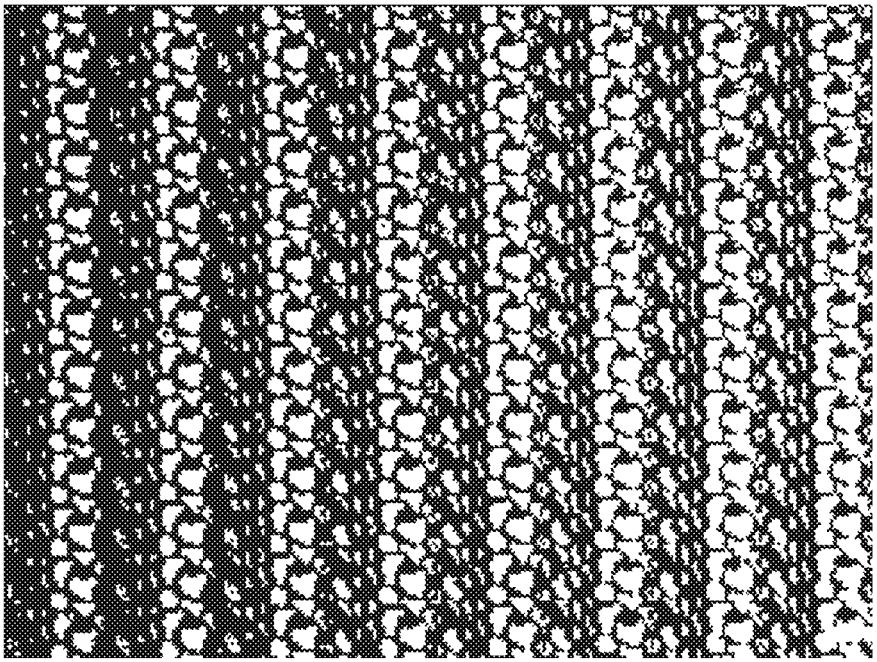
FIG. 9 is an explanatory diagram of an example of a normal ejection-order mask.

FIG. 9 is an explanatory diagram of an example of a normal ejection-order mask. The normal ejection-order mask illustrated in FIG. 9 sets a landing order (placement order) of ink droplets to be ejected from the ejection heads according to the scan direction of the carriage 11. When the normal ejection-order mask is used, complicated image processing is not performed. Accordingly, print speed can be increased by forming an image at a minimum resolution to make effective use of resolution of each of the heads. However, an image formed using the normal ejection-order mask can be degraded in image quality. This is because characteristics (ejection deflection, velocity fluctuation, and the like) of individual nozzles of each of the heads can affect a final image by causing, for example, such banding as that described above with reference to FIG. 3 to occur. Referring to the example illustrated in FIG. 9, unevenness in image quality between the forward direction 21 and the backward direction 22 appears like vertical streaks.

Figure 10:
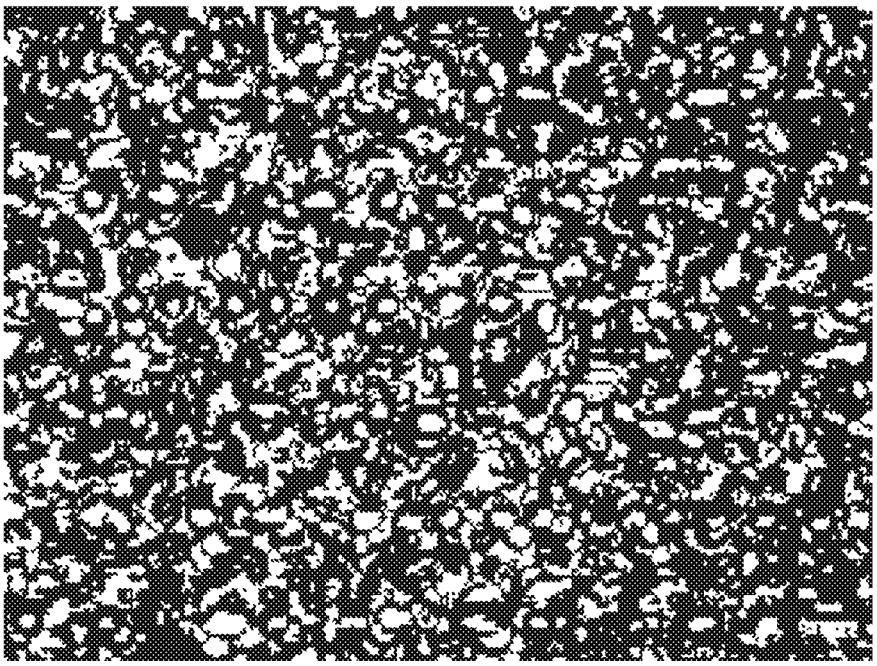
FIG. 10 is an explanatory diagram of an example of a random ejection-order mask.

FIG. 10 is an explanatory diagram of an example of a random ejection-order mask. The random ejection-order mask illustrated in FIG. 10 randomly changes a landing order (placement order) of ink droplets to be ejected from the ejection heads. More specifically, when the random ejection-order mask is used, the order, in which ink droplets are placed on a predetermined region where an image is to be formed, is randomly changed so as to prevent dot coalescence. Use of the random ejection-order mask enables forming an image of favorable image quality. Referring to the example illustrated in FIG. 10, because dots (ink droplets) are placed randomly, an image of uniform image quality free from such vertical streaks as those illustrated in FIG. 9 is obtained. Image quality can be changed while using the same random ejection-order mask by controlling, for example, choice of either bidirectional printing or unidirectional printing and the number of scans (i.e., the number of parts, into which the nozzle rows are to be divided). For example, a combination of the random ejection-order mask and unidirectional printing can increase image quality as compared with a combination of the random ejection-order mask and bidirectional printing. For another example, a combination of the random ejection-order mask and a larger number of scans can increase image quality as compared with a combination of the random ejection-order mask and a smaller number of scans. The respective control actions described above can be combined as desired depending on various conditions such as required image quality and required production speed.

Figure 11:
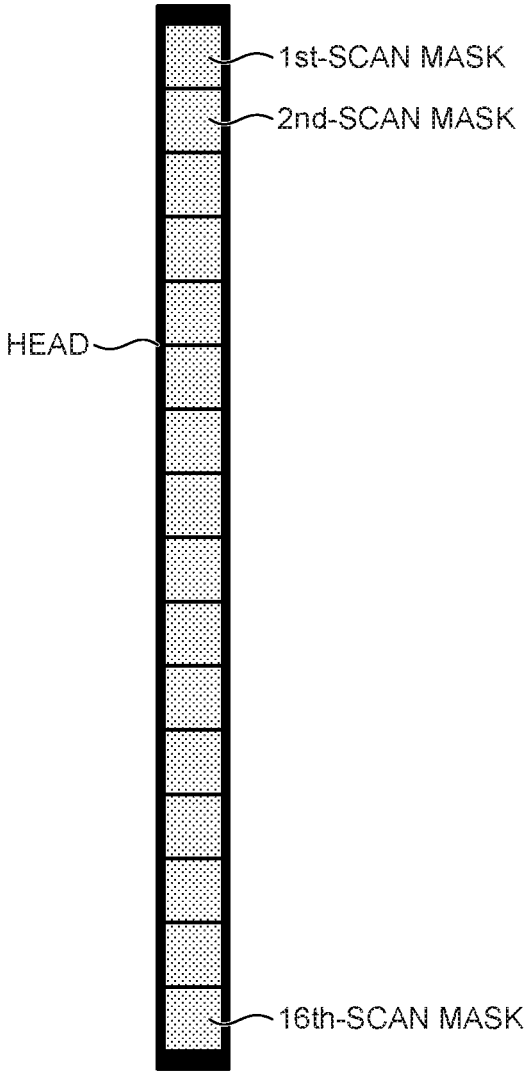
FIG. 11 is an explanatory diagram of an example of nozzle rows used in 16-scan printing.
Figure 12:
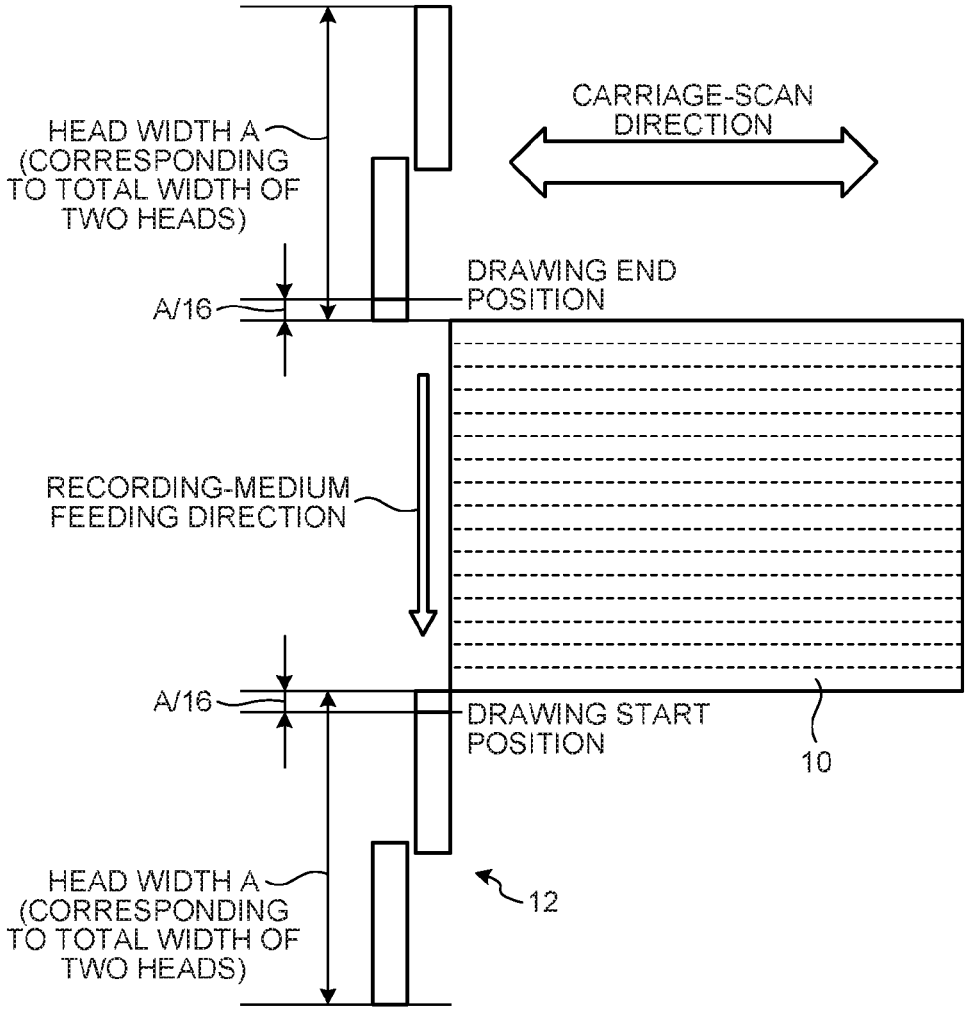
FIG. 12 is an explanatory diagram of the example of the nozzle rows used in 16-scan printing.

The number-of-scan control may be performed by, for example, performing printing with the nozzle rows of the head unit 12 divided into parts. The number-of-scan control according to the present embodiment is described below with reference to FIGS. 11 and 12. FIGS. 11 and 12 are diagrams for describing of an example of nozzle rows used in 16-scan printing. Description is given by way of example of unidirectional 16-scan printing. Referring to FIG. 11, the top one is a 1st-scan mask, the second top one is a 2nd-scan mask, and the bottom one is a 16th-scan mask. Referring to FIG. 12, two heads for a same color are connected in the head unit 12 in the lower portion of the drawing. A head width A corresponds to a total width of the two heads. As illustrated in FIG. 11, the head width A indicates that the head width A is printed with the nozzle rows divided into 16 parts. Meanwhile, "A/16" indicates that the head width A is divided into 16 parts and represents one-sixteenth of the nozzle rows (hereinafter, "1/16 nozzle-row part"). The recording medium 10 is conveyed in the recording-medium feeding direction indicated by an arrow in FIG. 12. As illustrated in FIG. 11, printing is sequentially performed from the 1st-scan mask to the 16th-scan mask with the 1/16 nozzle-row parts of the head unit 12 from a drawing start position in the lower portion of FIG. 12 to reach a drawing end position illustrated in the upper portion of FIG. 12. Note that, although the scan direction of the carriage 11 is bidirectional in the illustrated example to increase productivity, unidirectional scanning is more preferable when increasing image quality is desired.

As illustrated in FIG. 11, in the 16-scan printing setting, printing is performed by longitudinally dividing the nozzle rows, in their entirety, of the heads into 16 parts. The 1st-scan mask is applied as illustrated in FIG. 11 using a 1/16 (A/16) nozzle-row part group on the right-side one of the two heads illustrated in FIG. 12. Thereafter, the 2nd-scan mask is applied using a 2/16 nozzle-row part group on the right-side one of the two heads illustrated in FIG. 12. This process is repeatedly and sequentially performed until the 16th-scan mask is applied. FIG. 11 illustrates an example of multi-pass printing using random ejection-order masks. FIG. 12 is a schematic diagram illustrating how the printing illustrated in FIG. 11 proceeds with time. When compared with a normal ejection-order mask, a random ejection-order mask that changes nozzles to be used for each pass makes an image less susceptible to influence of ejection characteristics, such as ejection deflection, of the individual nozzles, thereby distributing characteristic variations of the nozzles over the entire image. Changing the number of scans is equivalent to changing the number of parts, into which the head rows (nozzle rows) are to be divided. The higher the number of scans, the less susceptible to the influence of ejection deflection. However, increasing the number of scans decreases print speed.

Thus, by controlling the image formation processes on a per-layer basis even when the layers to be formed are identical in resolution by, for example, setting the number of scans for forming the ink droplet film of the uppermost layer 33, which directly affects image quality of a finished image, large and setting the number of scans for the ink droplet film of each lower layer other than the uppermost layer 33 small, necessary functions that vary on the per-layer basis can be obtained.

The control of the ink droplet volume to be ejected from the ejection heads (i.e., control of the size of the landing ink droplets) may be performed by, for example, reducing the size of the ink droplets to be ejected from the ejection heads to form the ink droplet film of the uppermost layer 33 to a size smaller than the size of the ink droplets for forming the ink droplet film of the each lower layer other than the uppermost layer 33. In other words, a control action of, when forming the ink droplet film of the uppermost layer 33, reducing the ink droplet volume to be ejected from the ejection heads to a value smaller than the ink droplet volume for forming the ink droplet film of the each lower layer other than the uppermost layer 33 may preferably be performed.

Figure 13:
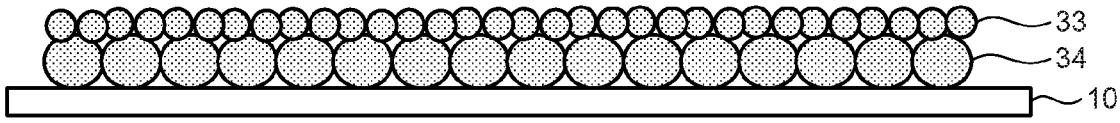
FIG. 13 is an explanatory diagram of an example of ink droplet volumes ejected from ejection heads.

The control of the ink droplet volume to be ejected from the ejection heads of the present embodiment is described below with reference to FIG. 13. FIG. 13 is an explanatory diagram of an example of ink droplet volumes ejected from the ejection heads. As illustrated in FIG. 13, the ink droplet (dot) volume of a lower layer 34 formed on the recording medium 10 is, for example, 14 pl (picoliter). The ink droplet (dot) volume of the uppermost layer 33 is, for example, 7 pl. That is, the ink droplet volume of the uppermost layer 33 is controlled to a half of the ink droplet volume of the lower layer 34. Controlling the ink droplet volume is equivalent to controlling the ink droplet size. In the example illustrated in FIG. 13, because the ink droplet volume of the uppermost layer 33 is small, the ink droplet size is also small, and hence the diameter of dots forming the image is also small. Accordingly, because image quality of the image formed with the ink droplet film of the uppermost layer 33 is increased, higher image quality can be achieved. In the example illustrated in FIG. 13, because the ink droplet volume (14 pl) of the lower layer 34 is large (i.e., the ink droplet size is large), the number of scans is, for example, 8. Because the ink droplet volume (7 pl) of the uppermost layer 33 is small (i.e., the ink droplet size is small), the number of scans is, for example, 16. Furthermore, the lower layer 34 is formed by bidirectional printing, while the uppermost layer 33 is formed by unidirectional printing. As described above, by combining the control of the ink droplet volume (i.e., control of the ink droplet size), the scan direction control, the number-of-scan control, the resolution control, and the like, a thick film of multiple layers, in which each layer has film property necessary for the layer, can be obtained.

Figure 14:
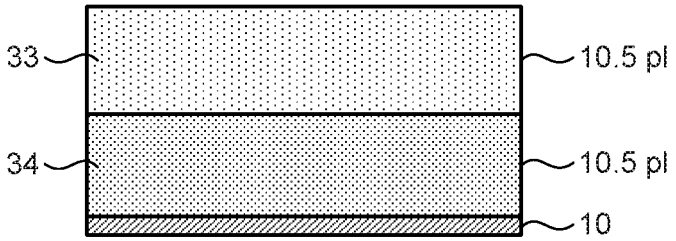
FIG. 14 is a diagram illustrating an example of a schematic layer cross section of an image formed of two layers.
Figure 15:
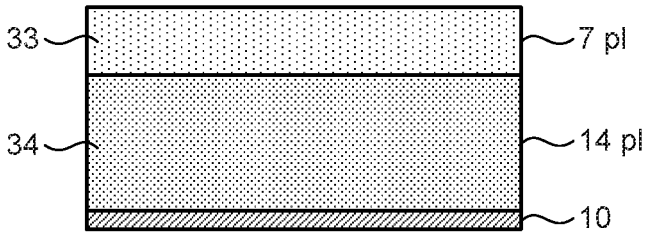
FIG. 15 is a diagram illustrating an example of a schematic layer cross section of an image formed of two layers.
Figure 16:
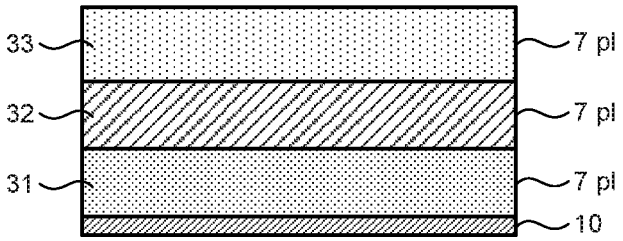
FIG. 16 is a diagram illustrating an example of a schematic layer cross section of an image formed of three layers.

Other form than that described above of the control of the ink droplet volume is described below with reference to FIG. 14 to FIG. 16. FIGS. 14 and 15 are diagrams each illustrating an example of a schematic layer cross section of an image formed of two layers. FIG. 16 is a diagram illustrating an example of a schematic layer cross section of an image formed of three layers.

In each of the examples illustrated in FIGS. 14 to 16, when forming an image of multiple layers of ink droplet films, a control action of adjusting a total of ink droplet volumes to be ejected to form all the layers of the image to a fixed value even if the number of layers of the ink droplet films making up the image varies is performed. By adjusting the total of the ink droplet volumes (total ink droplet volume) to be ejected to form all the layers to a fixed value, the film thickness of the multiple layers making up the image can be fixed. Because the film thickness can be fixed even if the number of layers of the ink droplet films making up an image varies from one image to another in this manner, fixing a transmission density can be achieved. In particular, an opaque portion of a display panel of a vehicle's display device (vehicle instrument) is desired to have a transmission density that does not permit light transmission, which arises the need of forming a thick film at the opaque portion. The present embodiment increases image quality of an image while maintaining the film thickness unvaried even if the number of layers making up a thick film varies.

In each of the examples illustrated in FIGS. 14 and 15, two ink droplet film layers, which are the lower layer 34 and the uppermost layer 33, are formed on the recording medium 10. In the example illustrated in FIG. 14, the ink droplet volume of the lower layer 34 adhered to the recording medium 10 is 10.5 pl, and the ink droplet volume of the uppermost layer 33 is 10.5 pl. Accordingly, a total of the ink droplet volumes (total ink droplet volume) is 21 pl. In the example illustrated in FIG. 15, the ink droplet volume of the lower layer 34 adhered to the recording medium 10 is 14 pl, and the ink droplet volume of the uppermost layer 33 is 7 pl. Accordingly, a total of the ink droplet volumes (total ink droplet volume) is 21 pl. In the image formation processes of FIG. 14, the lower layer 34 is formed by bidirectional printing and the uppermost layer 33 is formed by unidirectional printing. In the example illustrated in FIG. 14, although the lower layer 34 and the uppermost layer 33 are identical in the ink droplet volume, image quality of a final image can be increased by forming the uppermost layer 33 by unidirectional printing. In the image formation processes of FIG. 15, the lower layer 34 is formed by bidirectional printing and the uppermost layer 33 is formed by unidirectional printing. In the example illustrated in FIG. 15, because the ink droplet volume of the lower layer 34 is larger than that of FIG. 14, ink droplets are sufficiently leveled. Accordingly, image quality of the image can be further increased by virtue of an increase in adherence to the recording medium 10 and the smaller ink droplet volume of the uppermost layer 33.

In the example illustrated in FIG. 16, three ink droplet film layers, which are the lowermost layer 31, the intermediate layer 32, and the uppermost layer 33, are formed on the recording medium 10. In the example illustrated in FIG. 16, the ink droplet volume of the lowermost layer 31 adhered to the recording medium 10 is 7 pl; the ink droplet volume of the intermediate layer 32 is 7 pl; and the ink droplet volume of the uppermost layer 33 is 7 pl. Accordingly, a total of the ink droplet volumes (total ink droplet volume) is 21 pl. In the image formation processes of FIG. 16, the lowermost layer 31 is formed by bidirectional printing, the intermediate layer 32 is formed by bidirectional printing, and the uppermost layer 33 is formed by unidirectional printing. In the example illustrated in FIG. 16, because the number is layers is larger than that of FIGS. 14 and 15, the length of time for forming all the layers making up the image is longer. However, because the ink droplet films of high image quality are stacked from the lowermost layer 31, highest image quality of a final image can be achieved.

As described above, when forming an image made of multiple layers having a fixed film thickness by adjusting the total of the ink droplet volumes (the total ink droplet volume) forming all the layers of the image to a fixed value, if the number of the layers is fixed, functions of the ink droplet films of the respective layers and productivity can be controlled by controlling a combination of the ink droplet volumes. If the number of the layers varies, functions of the ink droplet films of the respective layers and productivity can be controlled by controlling the combination of the ink droplet volumes and a combination of scan directions. Note that the numbers of layers and the combinations of the ink droplet volumes of the respective layers described above with reference to FIGS. 14 to 16 are only examples. Each of the numbers and the combination can be set as desired.

The timing control for emission of active energy line (UV light) may be performed by performing a control action of, for example, when forming an ink droplet film of the lowermost layer 31 contacting the recording medium 10, setting the length of time between landing of the ink droplets on the recording medium 10 and irradiation of the ink droplets with active energy line (UV light) longer than that for forming an ink droplet film of each upper layer other than the lowermost layer 31, and when forming the ink droplet film of the uppermost layer 33, setting the length of time between landing of the ink droplets on an ink droplet film of an immediately-precedingly-formed lower layer (which is the lowermost layer 31 or the intermediate layer 32) and irradiation of the ink droplets with active energy line (UV light) substantially equal to or shorter than that for forming the ink droplet film of the lower layer.

Thus, in the present embodiment, adherence of the ink droplets landed on the recording medium (base material) 10 to form the lowermost layer 31, which is directly adhered to the recording medium 10, is increased by causing the ink droplets to be sufficiently leveled. The leveling of the landed ink droplets may be controlled by, in the case of the image forming apparatus 100 using UV-curing ink, for example, controlling a parameter for the length of time between landing of the ink droplets on the recording medium (base material) 10 and irradiation of the ink droplets with UV light (active energy line). When the length of time between landing of ink droplets on the recording medium (base material) 10 and irradiation of the ink droplets with UV light (active energy line) is short, the landed ink droplets harden while the ink droplets are still standing (i.e., insufficiently leveled). When the length of time is long, the landed ink droplets horizontally spread (i.e., sufficiently leveled) and harden after being sufficiently leveled. In the present embodiment, leveling time for forming the ink droplet film of the lowermost layer 31 is set long, thereby increasing adherence of the lowermost layer 31 to the recording medium (base material) 10. Meanwhile, when the leveling time is set long, image quality of an image is degraded by wet spreading of landed ink droplets. For this reason, when forming the ink droplet film of the uppermost layer 33, which is desired to have fine image quality, the leveling time is preferably set short.

Such timing control for emission of active energy line (UV light) as that described above is desired when the material of the recording medium 10, on which the ink droplet film of the lowermost layer 31 is to be formed, is plastic (such as polypropylene or polyethylene). There is no functional group on the surface of a plastic material. Accordingly, when forming an image on a plastic material, the need of increasing adherence to an ink droplet film arises. Generally, many plastic materials contain a substance(s) promoting adhesion. However, there can be a case where a plastic material contains a catalyst(s) derived from a product. The catalyst(s) can be dispersed in a boundary between the base material (plastic material) 10 and the ink droplet film and weaken the adherence. Conventionally, a countermeasure such as cleaning the surface of the plastic material with solvent has been taken. However, this countermeasure makes it considerably difficult to configure an image forming procedure so as to be performed on-line. For this reason, as described above, adherence of ink droplets landed on the base material 10 is increased by causing the ink droplets to be sufficiently leveled by means of the timing control for emission of active energy line (UV light).

Meanwhile, light emission wavelength (nm), energy-emission intensity (peak irradiance) ($mW/cm^2$), and integral radiant exposure ($mJ/cm^2$) of UV light that cures the UV curing ink affects adherence between the ink and the base material 10, adherence between ink layers, and properties of a film to be formed. More specifically, film strength, gloss level, and film surface appearance are controllable by adjusting the energy-emission conditions of the UV light. It is desired that the energy-emission conditions be determined carefully and precisely because image quality of a final image depends on the energy-emission conditions. Under the circumstances, the emitter unit 13 of the present embodiment illustrated in FIG. 1 has a control function of changing a total output power of light emission spectra of respective output regions of the emitter unit 13 from 0% to 100%. Hence, the emitter unit 13 can change the energy-emission intensity (peak irradiance) ($mW/cm^2$) and the integral radiant exposure ($mJ/cm^2$) as desired to cure ink and obtain aimed film properties.

When ink droplets of a same composition are used, properties of films obtained by hardening the ink droplets vary depending on the output power control. Accordingly, not only mechanical and electrical controls of the emitter unit 13 but also the timing control for irradiation of ink droplets ejected from the ejection heads with UV light to form an image are key factors that determine image quality. By, each time one of the layers is printed, changing the energy-emission conditions such as the peak irradiance ($mW/cm^2$) and the integral radiant exposure ($mJ/cm^2$) to those appropriate for a role of the layer, optimum UV light emission can be performed. For example, a same integral radiant exposure ($mJ/cm^2$) can be obtained by using either a control condition of emitting intense light ($mJ/cm^2$) for a short period of time or a control condition of emitting weak light ($mJ/cm^2$) for a long period of time. However, if a certain integral radiant exposure is desired, it is necessary to take productivity into account because some control condition may involve the need of changing the conveyance velocity of the recording medium 10.

An image formation process for forming an image made of a single layer is simple. However, when an image formation process of stacking another one, two, or more layers is required to provide image quality of a certain film transmission density by inkjet printing, it is necessary to form a thick film with dots (ink droplets). Accordingly, it is required to stack a same image(s) on a finished lower image. In this case, an adherend of the lowermost layer 31 is the surface of the recording medium 10, while an adherend of each of formed upper layers other than the lowermost layer 31 is an ink layer. Because the adherend varies between layers in this manner, even if images of the respective layers are formed through a same image formation process, properties of ink droplet films undesirably vary. For example, when forming a film of three layers, the three layers are respectively desired to have the following specifications:

the first layer: required to have adherence to the base material (recording medium) 10, the second layer: required to have adherence to the lower ink droplet film (the first layer), and the third layer: required to be an image of high image quality.

Thus, each of the layers is desired to meet a corresponding one of the above specifications.

By controlling the image formation processes on a per-layer basis by combining the image resolution control and the process-linear-velocity control in addition to the above-described scan direction control, the number-of-scan control, the resolution control, the landing order control of ink droplets to be ejected from the ejection heads (i.e., control of the ejection-order masks), the control of the ink droplet volume to be ejected by means of drive waveform control of the ejection heads (i.e., control of the size of landing ink droplets), and the timing control for emission of active energy line (UV light), properties of coating of a final image can be controlled as desired.

Guidelines for the above-described control of the image formation processes may include the following:

(1) the scan direction control: bidirectional printing increases productivity, whereas unidirectional printing increases image quality of an image, (2) the number-of-scan control: the smaller the number of scans, the higher the productivity, whereas the larger the number of scans, the higher the image quality of an image, (3) the image resolution control: the lower the resolution, the higher the productivity, whereas the higher the resolution, the higher the image quality of an image, (4) the landing order control of ink droplets to be ejected from the ejection heads: the normal ejection order (which sets a placement order of ink droplets in order) increases productivity, whereas the random ejection order (which randomly changes the placement order of ink droplets) increases image quality of an image, (5) the control of the ink droplet volume to be ejected from the ejection heads (i.e., control of the size of landing ink droplets): for a same resolution, the larger the ink droplet volume (i.e., the larger the ink droplet size), the higher the productivity, whereas the smaller the ink droplet volume (i.e., the smaller the ink droplet size), the higher the image quality of an image, (6) the timing control for emission of active energy line (UV light): the earlier the energy-emission timing, the higher productivity and image quality of an image, whereas the later the energy-emission timing, the more sufficiently the ink droplets are leveled and adherence is increased, and (7) the process-linear-velocity control (control of the image formation process): the higher the process linear velocity, the higher the productivity, whereas the lower the process linear velocity, the higher the image quality of an image. Examples of the process linear velocity include scan velocity of the carriage 11 and the conveying velocity of the recording medium 10 in the image formation process.

Figure 17:
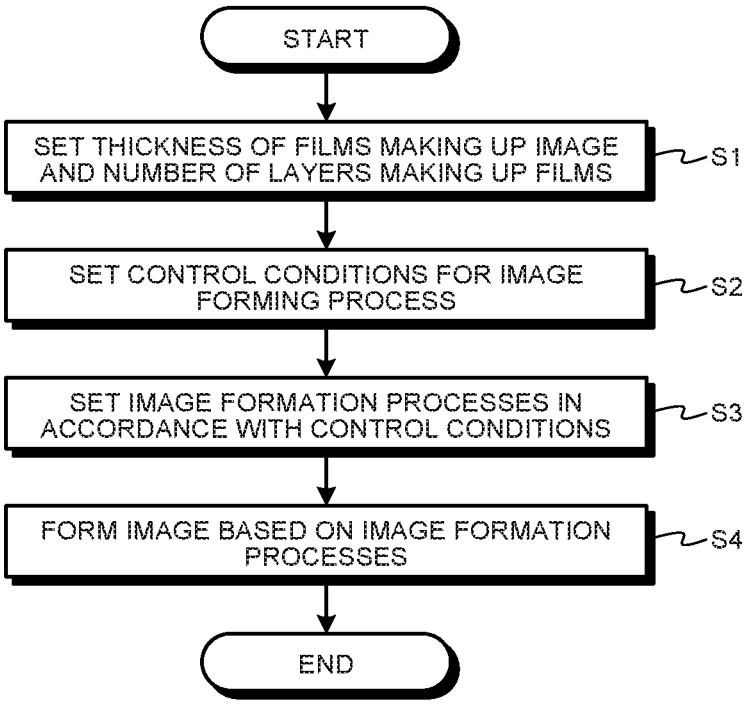
FIG. 17 is a flowchart for describing an example of operations to be performed by the image forming apparatus.

Operations to be performed by the image forming apparatus 100 according to the present embodiment are described below. FIG. 17 is a flowchart for describing an example of the operations to be performed by the image forming apparatus.

The image forming controller 133 sets the thickness of films making up an image and the number of layers making up the films (S1). Thereafter, the image forming controller 133 sets control conditions for an image forming process (S2). The image forming controller 133 sets, to the control conditions, at least any one of the following control actions: forming the ink droplet film of the uppermost layer 33 by unidirectional scan of the carriage 11, forming the same with the number of scans increased to a value higher than that for forming an ink droplet film of each lower layer other than the uppermost layer 33, forming the same with resolution of the image increased to a value higher than that for forming the ink droplet film of the each lower layer other than the uppermost layer 33, forming the same with the landing order of the ink droplets to be ejected from the ejection heads changed, and forming the same with an ink droplet volume to be ejected from the ejection heads reduced. The image forming controller 133 sets image formation processes in detail in accordance with the thus-set one or more control conditions (S3). Thereafter, the image forming controller 133 forms ink droplet films of the respective layers by controlling the ink ejection controller 141, the motor controller 142, and the emitter controller 143 in accordance with the thus-set image formation processes, thereby forming an image (S4).

By performing the above-described operations, the image forming apparatus 100 can reduce the time taken to form an image made of multiple layers of ink droplet films while maintaining fine image quality.

Thus, the image forming apparatus 100 of the present embodiment forms the ink droplet film of the uppermost layer 33 by performing at least any one of the following control actions: forming the ink droplet film by unidirectional scan of the carriage 11, increasing the number of scans to a value higher than that for forming the ink droplet film of each lower layer other than the uppermost layer 33, increasing resolution of the image to a value higher than that of the ink droplet film of the each lower layer other than the uppermost layer 33, changing the landing order of the ink droplets to be ejected from the ejection heads, and reducing an ink droplet volume to be ejected from the ejection heads to a value smaller than that for forming the ink droplet film of the each lower layer other than the uppermost layer 33, and forms the ink droplet film of the each lower layer other than the uppermost layer 33 by bidirectional scan of the carriage 11, thereby advantageously achieving reduction in the time taken to form an image made of multiple layers while maintaining fine image quality.

The program instructions to be executed by the above-described image forming apparatus 100 of the present embodiment may be configured to be provided as being recorded in a non-transitory computer-readable recording medium such as a CD-ROM, a flexible disk (FD), a CD-R, a digital versatile disk (DVD), or a universal serial bus (USB) memory as an installable file or an executable file. The program instructions may alternatively be configured so as to be provided or distributed via a network such as the Internet. The program instructions may alternatively be configured so as to be provided as being installed in a ROM or the like in advance.

Note that the configuration of the image forming apparatus 100 of the present embodiment is only an example and there are various configuration examples varying depending on use and purpose.

According to an aspect of the present invention, the time taken to form an image made of multiple layers can be reduced while maintaining fine image quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an ejection head configured to eject ink droplets onto a recording medium;

an emitter configured to emit active energy light to irradiate ink droplets on the recording medium, such that the ink droplets on the recording medium are cured and hardened;

a carriage configured to mount the ejection head and the emitter, the carriage further configured to scan in a first direction and a second direction, each direction of the first and second directions being perpendicular to a conveying direction of the recording medium; and an image forming controller configured to form a multilayer image on the recording medium, based on controlling ink droplet ejection by the ejection head, active energy light emission by the emitter, and scanning motion of the carriage to, execute a bi-directional scan sequence to form at least one lower ink droplet film layer of the multilayer image on the recording medium, the bi-direction scan sequence including, controlling the carriage to scan in the first direction and scan in the second direction, and controlling the ejection head to eject ink droplets during both the scan in the first direction and the scan in the second direction; and execute a uni-directional scan sequence to form an uppermost ink droplet film layer of the multilayer image on the at least one lower ink droplet film layer, the uni-directional scan sequence including, controlling the carriage to scan in the first direction and scan in the second direction, controlling the ejection head to eject ink droplets during the scan in the first direction, and controlling the ejection head to refrain from ejecting ink droplets during the scan in the second direction.

2. The image forming apparatus according to claim 1, wherein forming the uppermost ink droplet film layer includes performing at least one of, controlling the carriage to perform a greater quantity of scans, to form the uppermost ink droplet film layer, in relation to a quantity of scans performed by the carriage to form the at least one lower ink droplet film layer, setting an image resolution associated with the uppermost ink droplet film layer to a value that is greater than an image resolution associated with the at least one lower ink droplet film layer, changing a landing order of ink droplets that are ejected from the ejection head during a scan, and reducing an ink droplet volume that is ejected from the ejection head during a scan to a value smaller than an ink droplet volume ejected from the ejection head during a scan to form the at least one lower ink droplet film layer.

3. The image forming apparatus according to claim 1, wherein forming the at least one lower ink droplet film layer includes setting a landing order of the ink droplets according to a direction in which the carriage scans.

4. The image forming apparatus according to claim 1, wherein forming the uppermost ink droplet film layer includes reducing a size of the ink droplets that are ejected from the ejection head to form the uppermost ink droplet film layer to a size that is smaller than a size of the ink droplets that are ejected from the ejection head during execution of the bi-directional scan sequence to form the at least one lower ink droplet film layer.

5. The image forming apparatus according to claim 1, wherein the image forming controller is configured to maintain a quantity of ink droplet volume ejected to form all layers of the multilayer image at a fixed quantity.

6. The image forming apparatus according to claim 1, wherein, the at least one lower ink droplet film layer includes a lowermost ink droplet film layer contacting the recording medium and one or more intermediate ink droplet film layers on the lowermost ink droplet film layer, forming the lowermost ink droplet film layer includes controlling the ejection head to eject ink droplets having a first size, forming the one or more intermediate ink droplet film layers includes controlling the ejection head to eject ink droplets having a second size, the second size being equal to or smaller than the first size, and forming the uppermost ink droplet film layer includes controlling the ejection head to eject ink droplets having a third size, the third size being smaller than the second size.

7. The image forming apparatus according to claim 1, wherein forming the uppermost ink droplet film layer includes, randomly changing a placement order of the ink droplets that are ejected with reference to a direction in which the carriage scans.

8. An image forming apparatus, comprising:

an ejection head configured to eject ink droplets onto a recording medium;

an emitter configured to emit active energy light to irradiate ink droplets on the recording medium, such that the ink droplets on the recording medium are cured and hardened;

a carriage configured to mount the ejection head and the emitter and scan in a first direction and a second direction, each direction of the first and second directions being perpendicular to a conveying direction of the recording medium; and an image forming controller configured to form a multilayer image on the recording medium, based on controlling ink droplet ejection by the ejection head, active energy light emission by the emitter, and scanning motion of the carriage to, set a first time period associated with an elapse of a time period from landing of ink droplets on the recording medium to irradiation of landed ink droplets by the emitter, execute a first scan sequence to form at least one lower ink droplet film layer of the multilayer image on the recording medium, the at least one lower ink droplet film layer having a first level of image quality, the first scan sequence including controlling the carriage, emitter, and ejection head such that the ejection head ejects ink droplets that are irradiated by the emitter upon an elapse of the first time period, set a second time period associated with the elapse of the time period from landing of ink droplets on the recording medium to irradiation of landed ink droplets by the emitter, the second time period being equal to or smaller than the first time period, and execute a second scan sequence to form an uppermost ink droplet film layer of the multilayer image on the at least one lower ink droplet film layer, the uppermost ink droplet film layer having a second level of image quality that is greater than the first level of image quality, the second scan sequence including controlling the carriage, emitter, and ejection head such that the ejection head ejects ink droplets that are irradiated by the emitter upon an elapse of the second time period.

9. The image forming apparatus according to claim 8, wherein the at least one lower ink droplet film layer includes a lowermost ink droplet film layer contacting the recording medium and one or more intermediate ink droplet film layers on the lowermost ink droplet film layer, forming the lowermost ink droplet film layer includes controlling the emitter unit to irradiate ink droplets ejected on the recording medium upon an elapse of a first time period after the ink droplets land on the recording medium, forming the one or more intermediate ink droplet film layers includes controlling the emitter unit to irradiate ink droplets ejected on a preceding ink droplet layer upon an elapse of a second time period after the ink droplets land on the preceding ink droplet layer, the second time period being smaller than the first time period, and forming the uppermost ink droplet film layer includes controlling the emitter unit to irradiate ink droplets ejected on the one or more intermediate ink droplet layers upon an elapse of a third time period after the ink droplets land on the one or more intermediate ink droplet layers, the third time period being equal to or smaller than the second time period.

10. The image forming apparatus according to claim 8, wherein the image forming controller is configured to maintain a quantity of ink droplet volume ejected to form all layers of the multilayer image at a fixed quantity.

11. The image forming apparatus according to claim 8, wherein forming the uppermost ink droplet film layer includes randomly changing a placement order of the ink droplets that are ejected with reference to a direction in which the carriage scans.

12. An image forming method performed by an image forming apparatus including a carriage configured to scan in a direction perpendicular to a conveying direction of a recording medium with an ejection head and an emitter unit mounted on the carriage, the ejection head being configured to eject ink droplets that harden when exposed to active energy light onto the recording medium to form an image, the emitter unit being configured to emit the active energy light that cures the ink droplets landed on the recording medium, and an image forming controller configured to control ejection of the ink droplets from the ejection head and scan of the carriage, the image forming method comprising:

executing a bi-directional scan sequence to form the at least one lower ink droplet film layer of a multilayer image, the bi-direction scan sequence including, controlling the carriage to scan in a first direction and a second direction, and controlling the ejection head to eject ink droplets during both the scan in the first direction and the scan in the second direction; and executing a uni-directional scan sequence to form an uppermost ink droplet film layer of the multilayer image, the uni-direction scan sequence including, controlling the carriage to scan in the first direction and the second direction, controlling the ejection head to eject ink droplets during the scan in the first direction, and controlling the ejection head to refrain from ejecting ink droplets during the scan in the second direction.

13. The image forming method according to claim 12, wherein forming the uppermost ink droplet film layer includes reducing a size of the ink droplets that are ejected from the ejection head to form the uppermost ink droplet film layer to a size that is smaller than a size of the ink droplets that are ejected from the ejection head during execution of the bi-directional scan sequence to form the at least one lower ink droplet film layer.

14. The image forming method according to claim 13, wherein, forming the at least one lower ink droplet film layer includes forming a lowermost ink droplet film layer contacting the recording medium and forming one or more intermediate ink droplet film layers on the lowermost ink droplet film layer, forming the lowermost ink droplet film layer includes controlling the ejection head to eject ink droplets having a first size, forming the one or more intermediate ink droplet film layers includes controlling the ejection head to eject ink droplets having a second size, the second size being equal to or smaller than the first size, and forming the uppermost ink droplet film layer controlling the ejection head to eject ink droplets having a third size, the third size being smaller than the second size.

15. The image forming method according to claim 14, wherein, forming the lowermost ink droplet film layer includes controlling the emitter unit to irradiate ink droplets ejected on the recording medium upon an elapse of a first time period after the ink droplets land on the recording medium, forming the one or more intermediate ink droplet film layers includes controlling the emitter unit to irradiate ink droplets ejected on a preceding ink droplet layer upon an elapse of a second time period after the ink droplets land on the preceding ink droplet layer, the second time period being smaller than the first time period, and forming the uppermost ink droplet film layer includes controlling the emitter unit to irradiate ink droplets ejected on the one or more intermediate ink droplet layers upon an elapse of a third time period after the ink droplets land on the one or more intermediate ink droplet layers, the third time period being equal to or smaller than the second time period.

16. The image forming method according to claim 12, further comprising:

maintaining a quantity of ink droplet volume ejected to form all layers of the multilayer image at a fixed quantity.

17. The image forming method according to claim 12, wherein forming the uppermost ink droplet film layer includes randomly changing a placement order of the ink droplets that are ejected with reference to a direction in which the carriage scans.

* * * * *